US006394574B1

(12) United States Patent
Kotaki et al.

(10) Patent No.: US 6,394,574 B1
(45) Date of Patent: May 28, 2002

(54) INK JET PRINT HEAD HAVING PRESS MEMBER

(75) Inventors: Yasuo Kotaki, Yokohama; Akio Saito, Machida; Wataru Takahashi, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/491,866

(22) Filed: Jan. 27, 2000

(30) Foreign Application Priority Data

Jan. 27, 1999 (JP) ..... 11-018984

(51) Int. Cl.[7] ..... B41J 2/015
(52) U.S. Cl. ..... 347/20
(58) Field of Search ..... 347/20, 40, 42, 347/63, 50, 65, 67

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/56 |
| 4,459,600 A | | 7/1984 | Sato et al. | 347/65 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,262,802 A | | 11/1993 | Karita et al. | 347/87 |
| 5,389,957 A | | 2/1995 | Kimura et al. | 347/20 |
| 5,606,352 A | * | 2/1997 | Yamakawa et al. | 347/20 |
| 5,784,079 A | * | 7/1998 | Masuda et al. | 347/20 |
| 5,850,238 A | | 12/1998 | Karita et al. | 347/29 |
| 6,007,185 A | * | 12/1999 | Hirosawa et al. | 347/50 |

FOREIGN PATENT DOCUMENTS

| | | | |
|---|---|---|---|
| EP | 0 768 180 | 4/1997 | B41J/2/14 |
| JP | 54-56847 | 5/1979 | B41M/5/26 |
| JP | 59-123670 | 7/1984 | B41J/2/045 |
| JP | 59-138461 | 8/1984 | B41J/3/04 |
| JP | 60-71260 | 4/1985 | B41J/3/04 |
| JP | 3-101957 | 4/1991 | |
| JP | 10-71715 | 3/1998 | B41J/2/05 |

* cited by examiner

*Primary Examiner*—John Barlow
*Assistant Examiner*—Juanita Stephens
(74) *Attorney, Agent, or Firm*—Fitzpatrick Cella Harper & Scinto

(57) ABSTRACT

The pressing portion of the press member for joining the top plate and the heater board together is formed into projections A, which are pressed against the back of the heater board at the vicinity of the joint gravity center of the top plate and the heater board to firmly join the top plate and the heater board with a uniform pressure over their entire contact surface.

18 Claims, 12 Drawing Sheets

INK JET PRINT HEAD HAVING PRESS MEMBER

This application is based on U.S. patent application Ser. No. 11-18984 (1999) filed Jan. 27, 1999 in Japan, the content of which is incorporated hereinto by reference.

BACKGROUND OF THE INVENTION

1. Field of the Invention

The present invention relates to an ink jet print head in which ink paths for ejecting ink droplets are formed by joining together a grooved top plate and a heater board by a press member.

2. Description of the Prior Art

An ink jet printing system is recognized as a very effective printing system because it performs non-impact printing that produces virtually no noise during printing, because it is capable of high speed printing and because it requires no special fixing of a printed image on plain paper as a recording medium.

FIG. 14 is a schematic perspective view showing an essential portion of a conventional ink jet print head disclosed in Japanese Patent Application Laid-Open No. 3-101957. FIG. 15 is a cross section taken along the line Y—Y of FIG. 14.

In FIGS. 14 and 15, reference number 112 represents a heater board having a plurality of electrothermal transducers (not shown) as a heat source. A grooved top plate 113 has integrally formed therein a plurality of ink orifices 101, grooved ink paths 105 communicating with the ink orifices 101, wall portions 106 forming ink paths walls, and a recessed portion as a common liquid chamber 107 for supplying ink to the ink paths 105. Denoted 111 is a base plate to support components. Designated 114 is a spring member that joins together the heater board 112 and the grooved top plate 113 by a pressing force to form the ink paths 105.

The spring member 114 has a bent end portion 114A formed at its free end and presses it against a flat upper surface 113B of the top plate 113 to engage the top plate 113 with the heater board 112, with a pressing force of the spring member acting through a line contact. It has been a conventional practice to form the spring member 114 with the rigid bent end portion 114A and press the bent end portion 114A against the upper surface 113B of the top plate 113 to join the two members—the top plate 113 and the heater board 112—with the pressing force.

The ink jet printers of recent years have undergone price and size reductions and there is a corresponding increase in demand for a simplified structure of the ink jet print head. In a print head structure in which the top plate 113 is joined to the heater board 112 fixedly mounted on the base plate 111, the size of the print head is basically determined by the size of the base plate 111 and thus it is effective in reducing the size of the head to eliminate, or reduce the size of, the base plate 111. The structure with the base plate 111 eliminated or reduced in size, however, loses a heat dissipating function, one of the functions of the base plate 111, and thus requires some measures to suppress a temperature rise in the print head.

The official gazette of Japanese Patent Application Laid-Open No. 10-71715 discloses a technology in which the base plate is either eliminated or reduced in size to achieve a size reduction of the print head and also suppress a temperature rise in the print head.

FIG. 16 is an exploded perspective view of a conventional ink jet print head disclosed in the Japanese Patent Application Laid-Open No. 10-71715.

The print head of FIG. 16 has an orifice plate 202 formed with a plurality of ink orifices 201, a grooved top plate 200 having ink paths 203 and a common liquid chamber 204 integrally formed therein, a heater board 210 connected with a printed circuit board 205, and a spring press member 220. Instead of pressing the upper surface of the top plate 200 as in the preceding conventional art, this print head has the underside of the heater board 210 pressed by the spring press member 220 to bind the grooved top plate 200 and the heater board 210 together. The spring press member 220 is supported like a cantilever on a top plate mount (not shown) integrally formed with the grooved top plate 200.

In this print head, as shown in FIG. 17, the spring press member 220 presses the back of the heater board 210 at a position close to where electrothermal transducers 211 are installed, at a contact angle θ with a pressing force acting through a line contact, to ensure an intimate contact between the top plate 200 and the heater board 210. Further, in this print head, the spring press member 220 is made of a good thermal conductive material to release heat generated by the electrothermal transducers 211. The spring press member 220 is assigned a heat dissipating function of the base plate 111 of the prior art shown in FIG. 14.

(1) In the conventional technology, however, because the spring press member 220 presses, at a contact angle θ, a vicinity of the front edge of the heater board 210 close to where the electrothermal transducers 211 are installed as shown in FIG. 17, moments of force B and C as shown in FIG. 17 are generated. Hence, with this conventional technology the rear end of the heater board 210 tends to float from the grooved top plate 200. This makes the contact between them unstable.

(2) The grooved top plate 200 is made of a molding resin material and can easily produce warping and bending. As described earlier, the spring press member 220 is supported on the top plate mount formed integral with the grooved top plate 200, so that when the top plate 200 is warped or bent, the spring press member 220 is shifted from its normal support position and support angle. As a result, the position and angle of the pressing portion of the spring press member 220 are deviated.

Because the heater board 210 of the conventional technology is pressed by a pressing force acting through a line contact despite the fact that the spring press member 220 has variations in its position and attitude caused by warping and bending of the top plate 200, the pressing force acting through a line contact is directly affected by the variations in position and attitude of the spring press member 220 and is likely to fluctuate or be unevenly distributed. The conventional technology therefore has a problem of not being able to bind the top plate 200 and the heater board 210 together with a uniform contact pressure with respect to the arrangement direction of ink paths 8.

The present invention has been accomplished to solve the problem described above. It is therefore a primary object of the invention to provide an ink jet print head having a base plate eliminated or reduced in size in which the grooved top plate and the heater board are engaged together with a uniform pressure over their entire contact surface to securely hold them in close contact with each other.

It is another object of the invention to provide an ink jet print head capable of dissipating heat with an improved efficiency.

SUMMARY OF THE INVENTION

According to a first aspect of the present invention, the ink jet print head comprises: a grooved top plate having a plurality of groove-like ink paths, a common liquid chamber for supplying ink to the plurality of ink paths and a plurality of orifices for ejecting ink; a heater board having a plurality of heat generating elements for generating an ink ejection pressure arranged at positions on a front surface thereof corresponding to the plurality of ink paths; and a press member for pressing and joining together the grooved top plate and the heater board; wherein the press member presses against a back of the heater board at the vicinity of a joint gravity center of the heater board and the grooved top plate.

With this invention, because the press member presses against the back of the heater board at the vicinity of the joint gravity center of the heater board and the grooved top plate to bring the heater board and the grooved top plate into intimate contact with each other, it is possible to engage the heater board and the grooved top plate with a uniform pressure over their entire contact surface. This in turn enables the heater board and the grooved top plate to be intimately joined together for a long period of time. It is therefore possible to produce a stable ink ejection pressure in each ink path, thereby realizing a high quality printing.

In this invention, the plurality of projections formed on the press member are pressed against the back of the heater board at a plurality of points that are almost equal in position to the joint gravity center with respect to the longitudinal direction of the ink paths. This enables the heater board and the grooved top plate to be joined together with a uniform pressure over their entire contact surface even when the grooved top plate has warping or bending.

According to a second aspect of the present invention, the ink jet print head comprises: a grooved top plate having a plurality of groove-like ink paths, a common liquid chamber for supplying ink to the plurality of ink paths and a plurality of orifices for ejecting ink; a heater board having a plurality of heat generating elements for generating an ink ejection pressure arranged at positions on a front surface thereof corresponding to the plurality of ink paths; a press member for pressing and joining together the grooved top plate and the heater board; and a heat dissipating member arranged on a back of the heater board; wherein the press member presses against a back of the heat dissipating member at a position on the heat dissipating member corresponding to the vicinity of a joint gravity center of the heater board and the grooved top plate.

Because the heat dissipating member with a large heat conductivity is placed on the back of the heater board, the heat dissipating performance of the heater board can be improved. Further, because the heat dissipating member is arranged on the back of the heater board, the press member presses the heater board through the heat dissipating member. The pressing position on the heat dissipating member is the joint gravity center of the grooved top plate and the heater board, as in the first aspect of the invention. Therefore, this second aspect of the invention also produces the similar effects to those of the first aspect of the invention, such as the ability to join the heater board and the grooved top plate together with a uniform pressure over their entire contact surface.

The above and other objects, effects, features and advantages of the present invention will become more apparent from the following description of embodiments thereof taken in conjunction with the accompanying drawings.

DESCRIPTION OF THE PREFERRED EMBODIMENTS

Now, embodiments of the present invention will be described by referring to the accompanying drawings.

(First Embodiment)

The first embodiment of the invention will be explained by referring to FIGS. 1 to 4.

Figure 1:
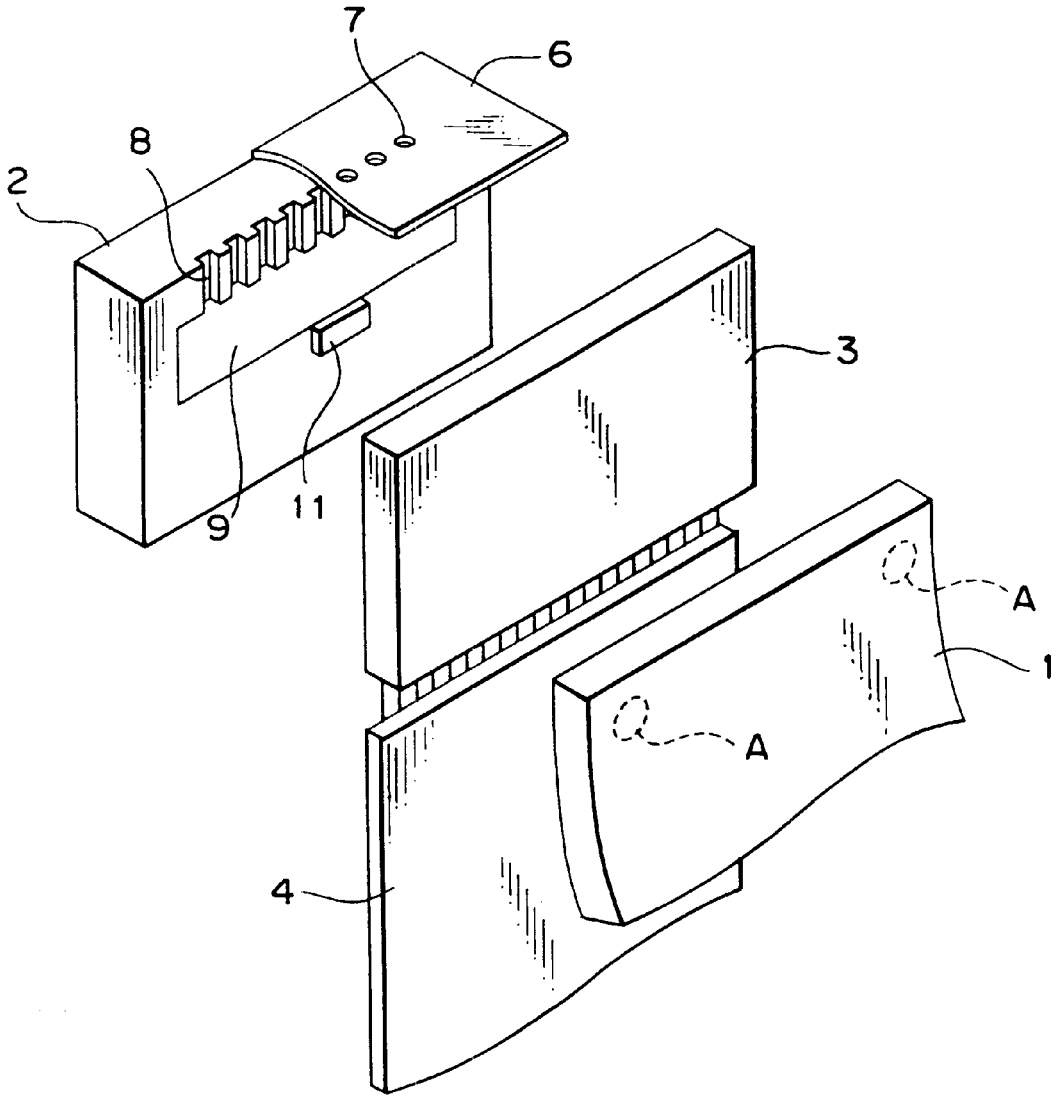
FIG. 1 is an exploded perspective view showing an essential portion of a first embodiment of the ink jet print head according to the invention.
Figure 2:
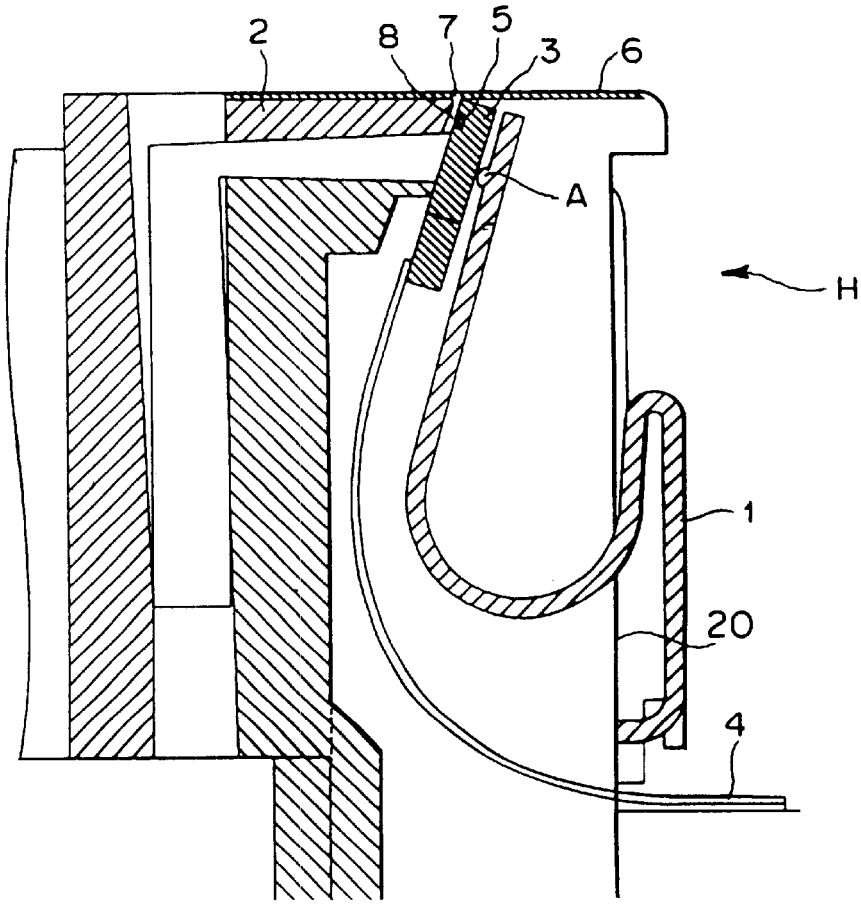
FIG. 2 is a schematic cross section of an essential portion of the ink jet print head of FIG. 1 cut in a direction crossing an orifice plate.
Figure 3:
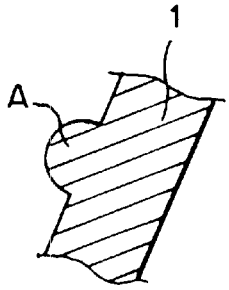
FIG. 3 is a cross section of a projection of the press member.

FIG. 1 is an exploded perspective view showing an essential portion of the first embodiment of the ink jet print head according to the invention. FIG. 2 is a cross section of components of the print head assembled together.

As shown in FIGS. 1 and 2, the print head of this embodiment has a grooved top plate 2, a heater board 3 and a press member 1, with the press member 1 pressing against the back of the heater board 3 to fixedly hold the heater board 3 and the grooved top plate 2 together.

The grooved top plate 2 is formed of a molding resin material, glass or metal as one piece and has an orifice plate 6 formed with a row of ink orifices 7, a plurality of ink paths 8 in the form of grooves, a common liquid chamber 9 for supplying ink to the ink paths 8. The common liquid chamber 9 is connected to an ink tank unit not shown. A reference projection 11 is formed on the grooved top plate 2 at a position behind an upper surface wall of the common liquid chamber 9. The reference projection 11 is located at a central portion with respect to the arrangement direction of the ink paths 8.

On the surface of the heater board 3 formed of silicon or the like (which faces the top plate 2) a plurality of electrothermal transducers 5 (see FIG. 2) are arranged at positions corresponding to the ink paths 8. The rear end of the heater board 3 is connected to a printed circuit board 4 to supply a power supply voltage and electric signals such as drive signals to the electrothermal transducers 5.

The press member 1 is a metal leaf spring with good thermal conductivity and is supported like a cantilever on a top plate mount 20 formed integral with the grooved top plate 2, as shown in FIG. 2. The press member 1 has, in this case, two projections A at predetermined positions in an area opposing the heater board 3. The two projections A, though shown in FIG. 3 as half-globes, may be of any shape as long as they can make a point contact. For example, they may take a pointed shape.

When the heater board 3 is joined to the grooved top plate 2, because a rear part of that surface of the grooved top plate 2 facing the heater board 3 contacts the heater board 3 through one point of the reference projection 11 arranged at the lateral center of that surface to receive a stress produced when the two members are pressed together, a front part of the grooved top plate 2, i.e., a portion where the ink paths 8 are formed, can be brought into secure engagement with the heater board 3 with a uniform contact pressure with respect to the arrangement direction of the ink paths 8 even when there is warping or dimensional variation of components such as top plate 2. A gap between the grooved top plate 2 and the heater board 3 is sealed with an appropriate sealing material when they are joined.

Figure 4:
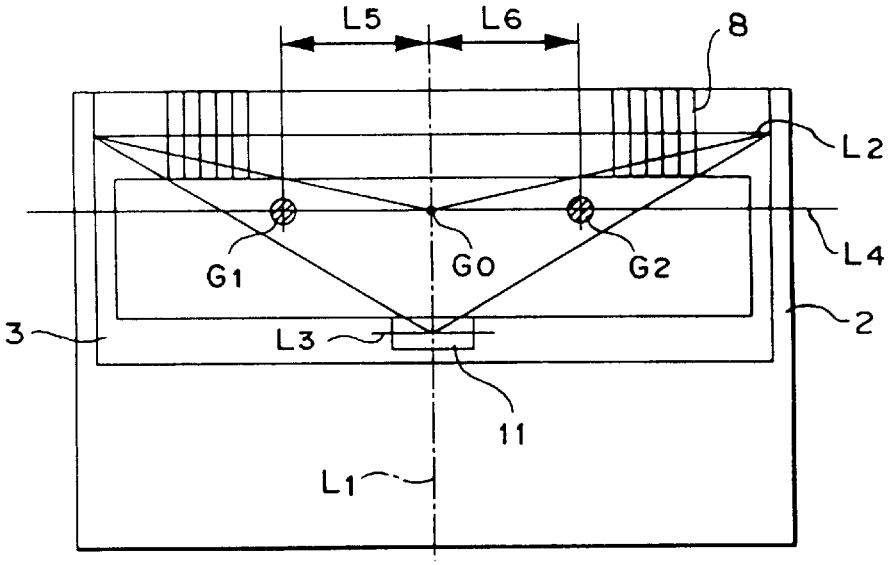
FIG. 4 is a plan view showing a center of gravity of joined members.

Next, by referring to FIG. 4, the positions of the projections A on the press member 1 will be explained. FIG. 4 is a plan view of the essential portion of the grooved top plate 2 as seen from an arrow H of FIG. 2.

The projections A formed in the press member 1 are located where they can press the vicinity of a gravity center of the grooved top plate 2 and the heater board 3 joined together. Pressing the gravity center of the joined members causes the heater board 3 and the grooved top plate 2 to engage each other with a uniform pressure over their entire contact surface. That is, both the top surface of the ink paths 8 of the grooved top plate 2 and the frame portion of the top plate forming the common liquid chamber 9 are reliably pressed.

Now, the gravity center of the joined members will be explained below.

As shown in FIG. 4, a triangle is formed by connecting the outermost ends of a line segment L2, which connects a plurality of longitudinal centers, with respect to the front and rear direction (longitudinal direction), of the ink paths 8, and the center of the reference projection 11. Then a center of gravity G0 of this triangle is determined and defined as a gravity center G0 of the joined members or a joint gravity center G0.

It is, however, difficult to pinpoint and press the joint gravity center G0 as a two-dimensional coordinate by the press member 1 during the joining process. In this embodiment, therefore, two points G1, G2, which are on a line segment L4 passing through the gravity center G0 parallelly to the line segment L2 and which are predetermined distances (L5=L6), on the left and right side, from a center line L1 of the grooved top plate 2 that passes through the center of the reference projection 11, are taken as joint gravity centers.

Although FIG. 4 shows only two points to be the joint gravity centers, four or six points or even greater numbers of points may be used as long as they are located the same distances on the left and right side from the center line L1. It is of course possible to arrange the projections A to press the joint gravity center G0.

Next, the thermal conductivity in the print head will be explained.

The thermal energy to eject ink is generated by electrothermal transducers 5 on the heater board 3 and a part of the generated heat is transmitted to the ink which is then expelled out of the print head through the ink orifices 7. The remaining heat is transmitted to the press member 1 situated on the back of the heater board 3, from which the heat is dissipated.

Figure 5:
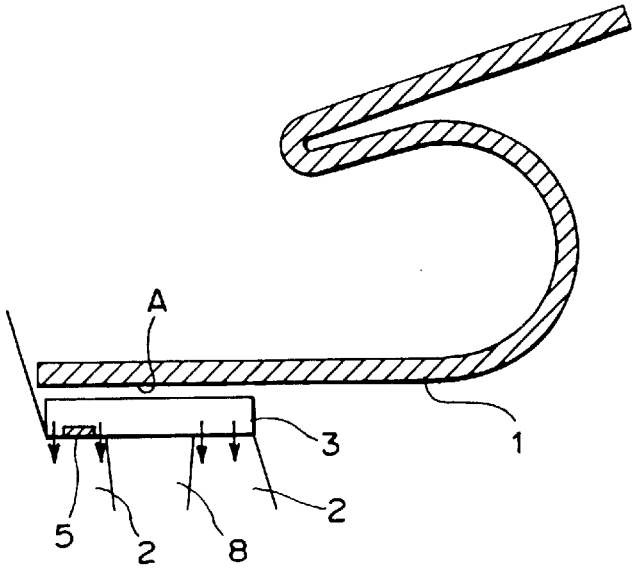
FIG. 5 is an enlarged cross section showing how the press member engages the heater board in the first embodiment of the invention.

In this embodiment, as shown in FIG. 5, the heater board 3 is pressed from the back at the vicinity of the joint gravity centers of the heater board 3 and the grooved top plate 2 to bring the heater board 3 and the grooved top plate 2 into intimate contact with each other. This allows the heater board 3 and the grooved top plate 2 to be reliably held against each other with a uniform pressure over their entire contact surface, which in turn ensures the intimate contact between the heater board 3 and the grooved top plate 2 for a long period of time. It is therefore possible to obtain stable ejection pressure in the individual ink paths 8, realizing high quality printing.

Further, in this embodiment, because the heater board 3 is pressed by a force acting through a point contact of the projections A as shown in FIG. 5, rather than through a line contact, the severity with which the pressing condition of the heater board 3 is directly affected by any warping or distortion of the members making up the grooved top plate 2 and by the resulting shift of the press member 1 from its normal position and angle can be alleviated. It is therefore possible to reduce fluctuating and uneven distributions of the pressure with which the heater board 3 is pressed, compared with those in the conventional print head. This enables the top plate 2 and the heater board 3 to be engaged together with a more uniform distribution of contact pressure.

(Second Embodiment)

Figure 6:
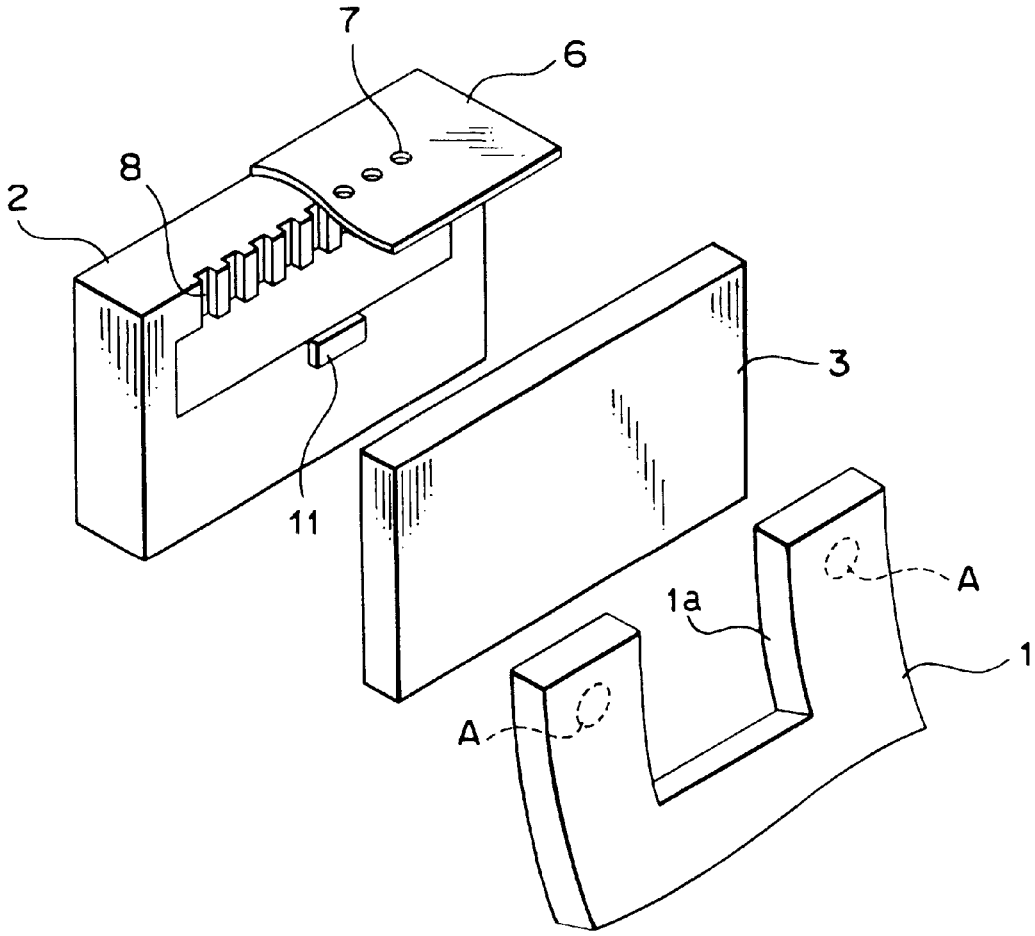
FIG. 6 is an exploded perspective view showing a second embodiment of the invention.
Figure 7:
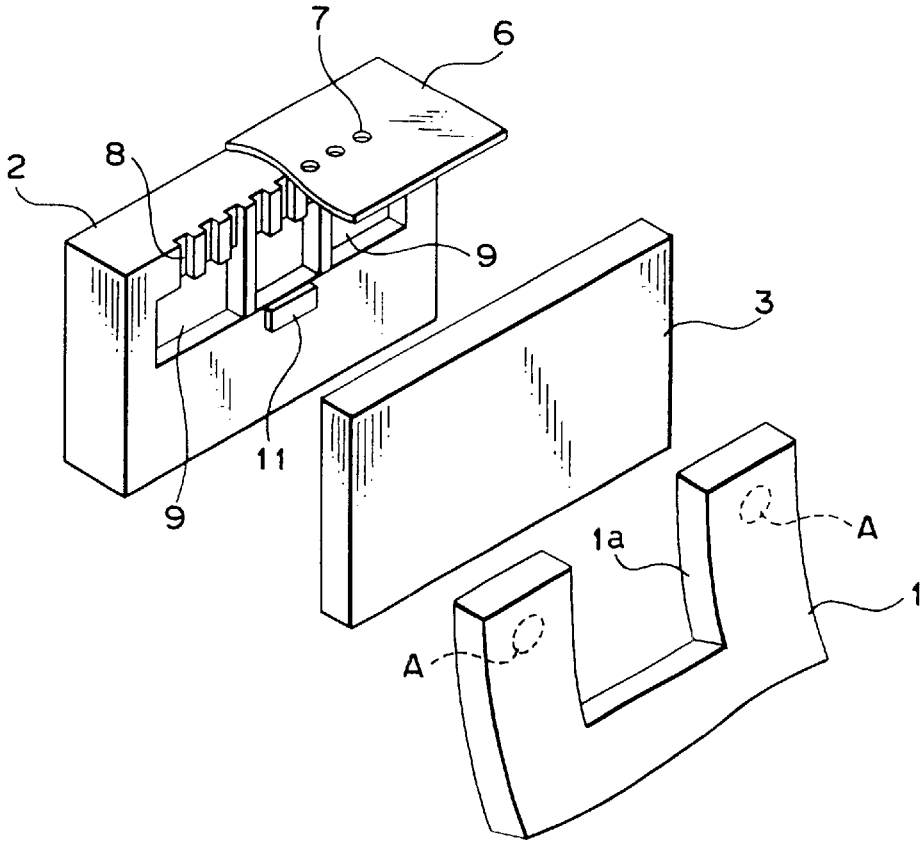
FIG. 7 is an exploded perspective view showing a variation of the second embodiment of the invention.

FIGS. 6 and 7 are exploded perspective views showing the construction of the second embodiment of the ink jet print head according to the invention. In this embodiment constitutional elements identical with the corresponding elements in the first embodiment are assigned like reference numbers and their explanations are omitted.

A feature of the second embodiment is that a slit 1*a* is formed in the press member 1 at its central portion between the projections A to divide the front end side of the press member 1 into a plurality of front end blocks like a comb. Because the heater board 3 is pressed independently by the individual projections A provided in each of the front end blocks divided by the slit 1*a,* the press member 1 can follow the surface contour of the back of the heater board 3 more easily than in the first embodiment as it is pressed against the heater board 3, even when the heater board 3 is warped. Hence, the intimate contact between the grooved top plate 2 and the heater board 3 can be improved. In this case, as the number of the divided front end blocks increases, the contact between the top plate 2 and the heater board 3 becomes more intimate.

An ink jet print head with a plurality of liquid chambers 9 as shown in FIG. 7 can also produce the similar effect.

Figure 8:
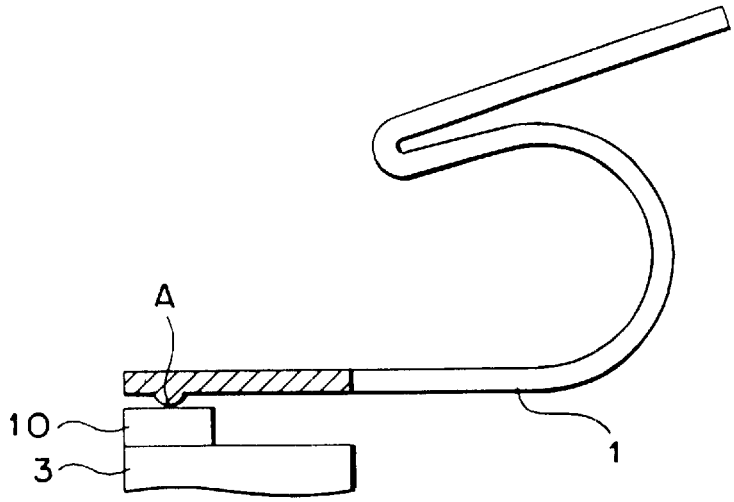
FIG. 8 is a schematic cross section showing the construction of the variation with a heat dissipating member added.

FIG. 8 shows a construction in which a heat dissipating member 10 of, for example, aluminum with good thermal conductivity is provided between the press member 1 and the heater board 3 to further improve the heat dissipating capability of the press member 1. The pressing positions of the projections A are located at the joint gravity centers of the grooved top plate 2 and the heater board 3.

(Third Embodiment)

Figure 9:
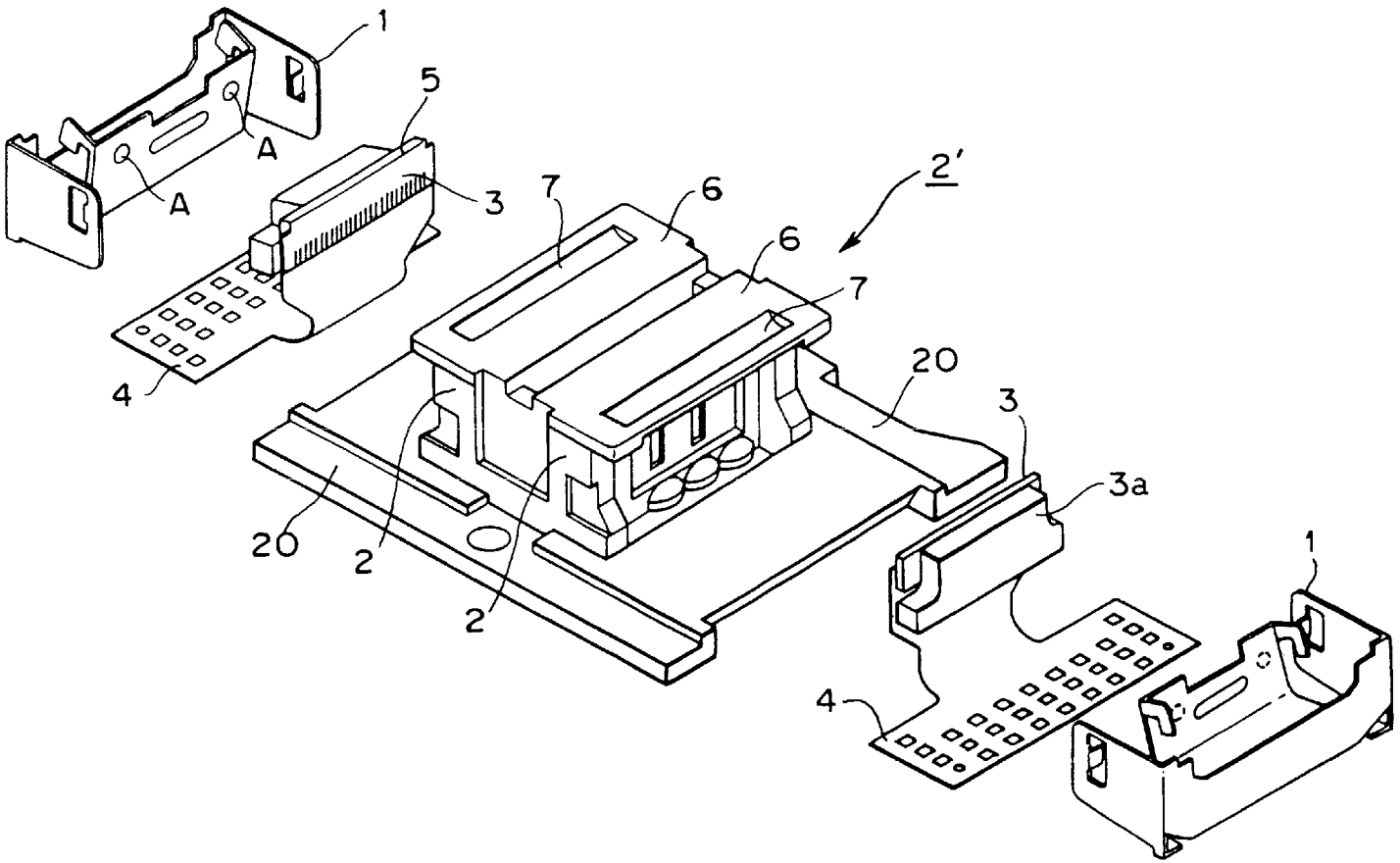
FIG. 9 is an exploded perspective view showing the construction of a third embodiment of the invention.
Figure 10:
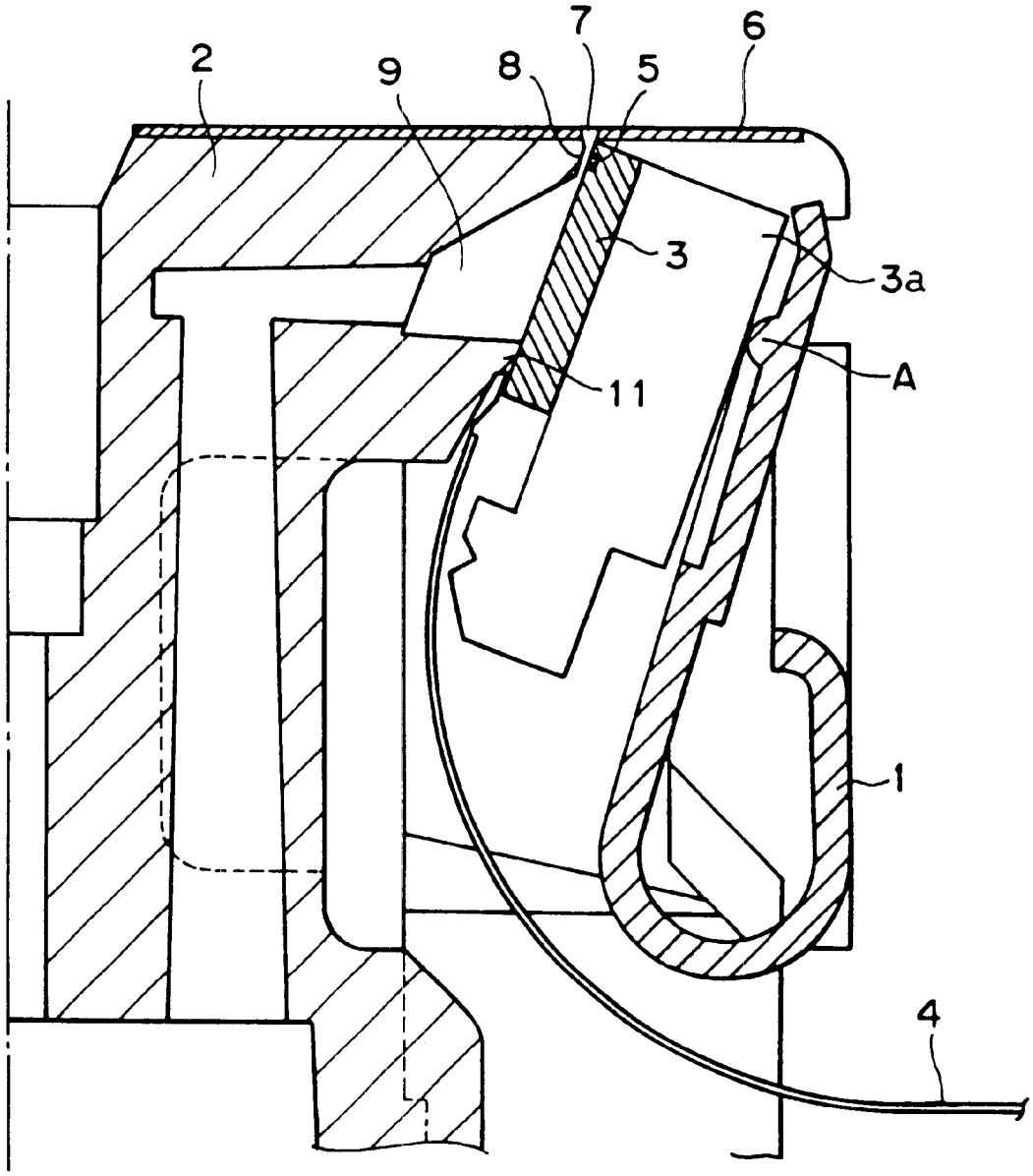
FIG. 10 is an enlarged schematic cross section showing an essential portion of the third embodiment of the print head.

The third embodiment of the invention will be described by referring to FIGS. 9 and 10. FIG. 9 is an exploded perspective view of the third embodiment of the ink jet print head. FIG. 10 is an enlarged schematic cross section showing an essential portion of the print head of FIG. 9.

In the third embodiment, a small base plate 3*a* as a heat dissipating member is provided on the back of the heater board 3 so that the press member 1 presses the heater board 3 through the small base plate 3*a*. The press member 1 has a plurality of projections A as in the previous embodiments, which are pressed against the small base plate 3*a* at positions corresponding to the joint gravity centers of the grooved top plate 2 and the heater board 3.

As shown in FIG. 9, a grooved top plate module 2' has a pair of grooved top plates 2 formed integrally on the top plate mount 20 to form two print heads, each having a row of ink orifices. There are also a pair of the heater board 3 and the press member 1. A pair of grooved top plates 2 are disposed such that a groove-forming portion of each said grooved top plate 2 is oriented outwardly.

The press members 1 are each fixedly supported on the top plate mount 20 of the grooved top plate module 2' as in the previous embodiments.

In this embodiment, the provision of the small base plate 3*a* as a heat dissipating member with high thermal conductivity on the back of the heater board 3 improves the heat dissipating performance over the previous embodiments. Because the small base plate 3*a* is arranged on the back of the heater board 3, the press member 1 presses the heater board 3 through the small base plate 3*a,* with the pressing positions set at the joint gravity centers of the grooved top plate 2 and the heater board 3 as in. the previous embodiments. Therefore, the similar effects to those of the previous embodiments can be produced, which include an advantage that the heater board 3 and the grooved top plate 2 can be held against each other with a uniform pressure over their entire contact surface.

(Fourth Embodiment)

Figure 11:
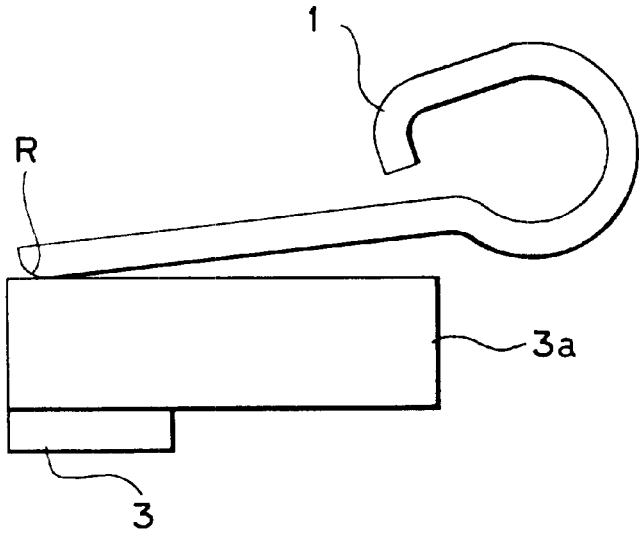
FIG. 11 is a schematic cross section showing the construction of a fourth embodiment of the invention.

FIG. 11 shows the fourth embodiment of the invention.

In a construction in which the heater board 3 with the small base plate 3*a* used in the third embodiment and the grooved top plate 2 are joined together by the press member 1, the fourth embodiment is characterized in that the front end portion of the press member 1 is rounded as indicated at R and that the rounded end portion of the press member 1 is pressed, through the small base plate 3*a,* against the heater board 3 in the vicinity of the joint gravity centers of the grooved top plate 2 and the heater board 3.

This embodiment is achieved by taking into consideration the heat dissipation from the head and the fact that the press member 1 is formed of a plate material, such as a metal plate, and offers an advantage that the shape of the press member 1 is simplified by rounding the pressing portion of the press member 1.

(Fifth Embodiment)

Figure 12:
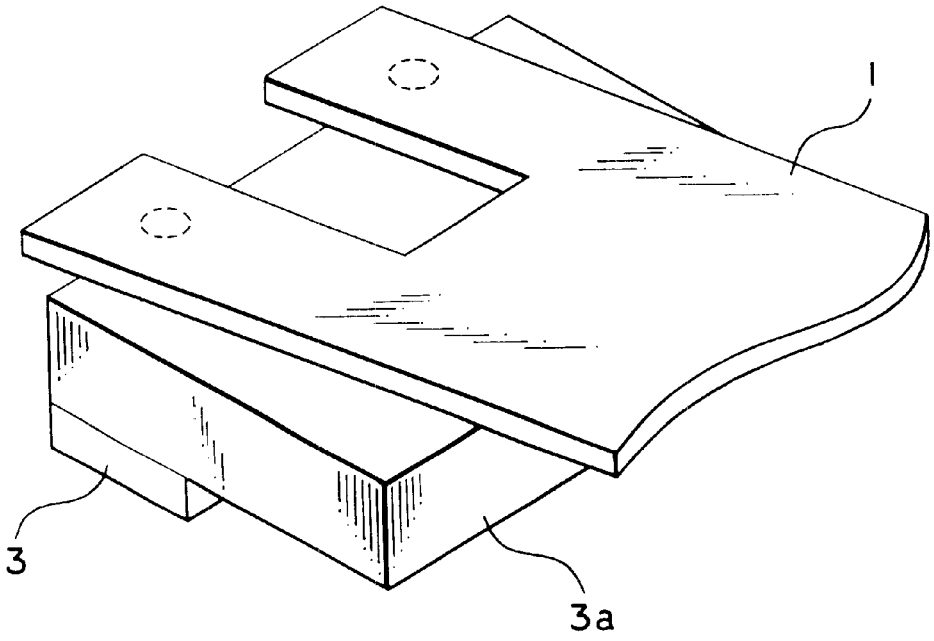
FIG. 12 is a schematic perspective view showing the construction of a fifth embodiment of the invention.
Figure 13:
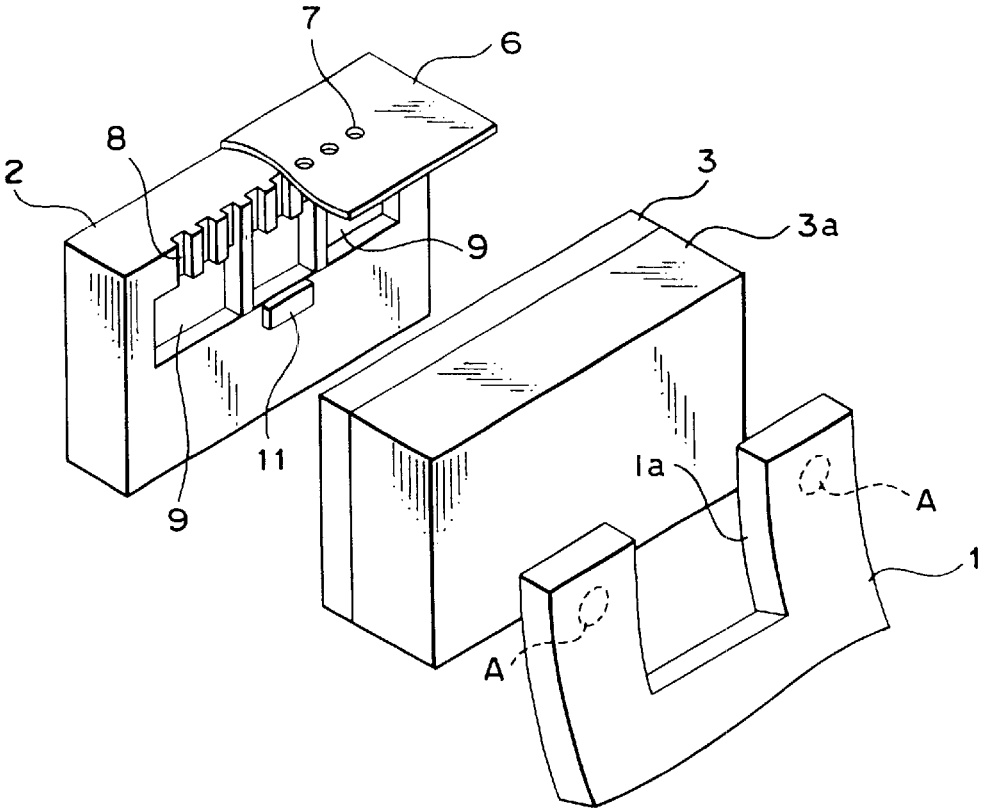
FIG. 13 is an exploded perspective view showing a variation of the fifth embodiment of the invention.
Figure 14:
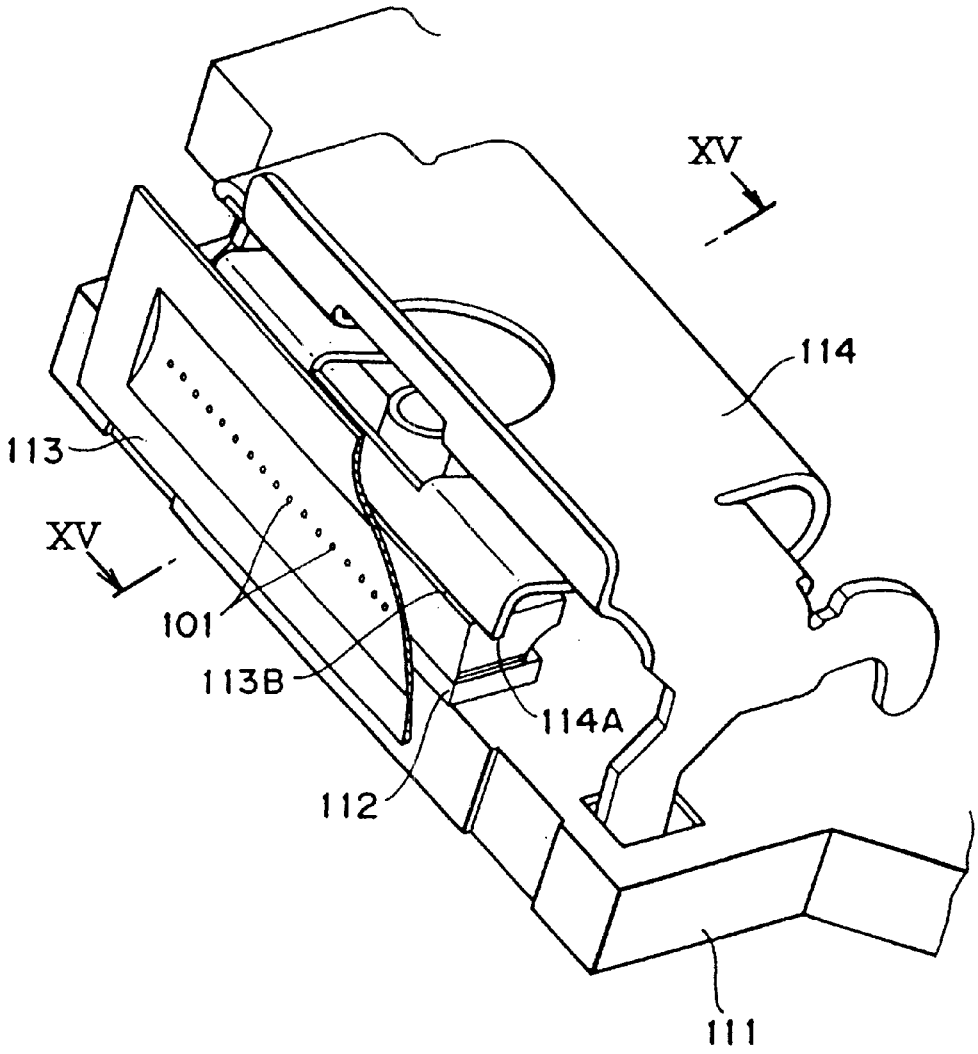
FIG. 14 PRIOR ART
FIG. 14 is a schematic perspective view showing a conventional ink jet print head.
Figure 15:
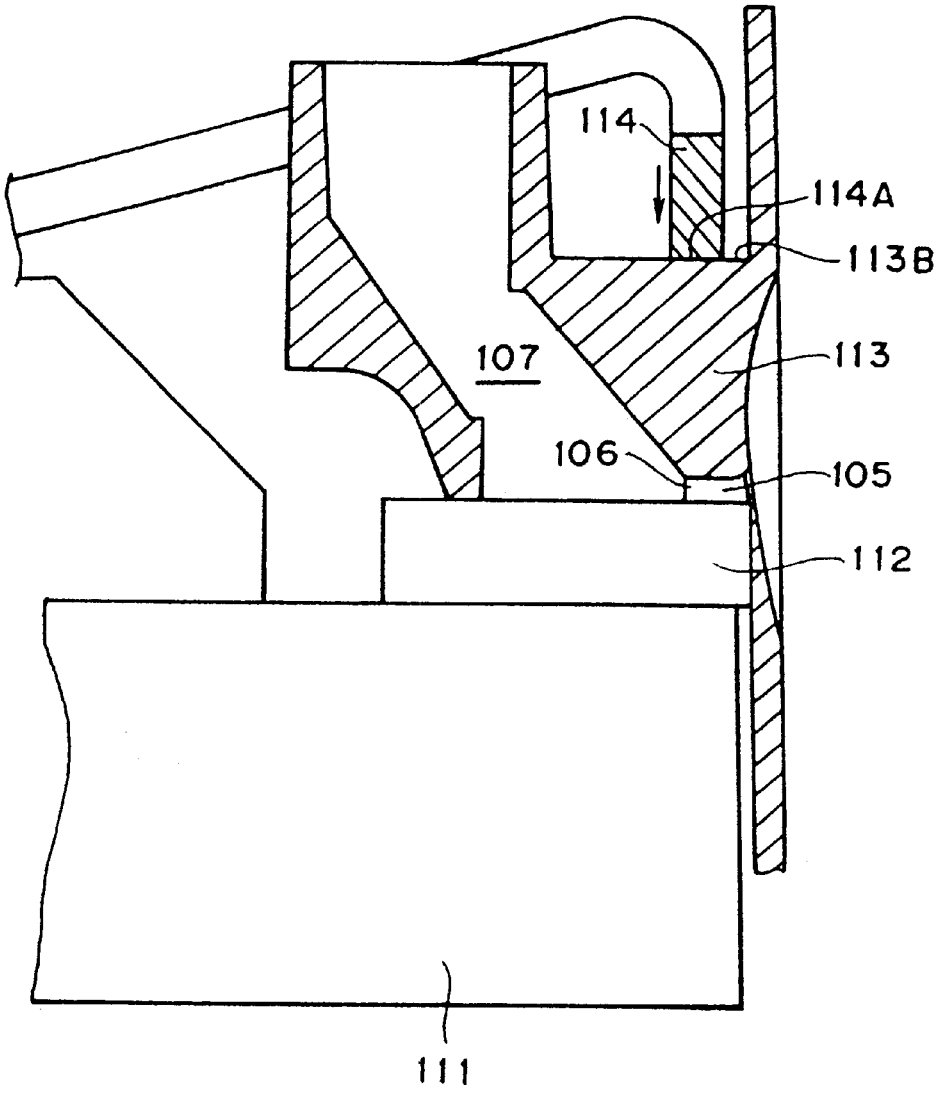
FIG. 15 PRIOR ART
FIG. 15 is a cross section taken along the line Y—Y of FIG. 14.
Figure 16:
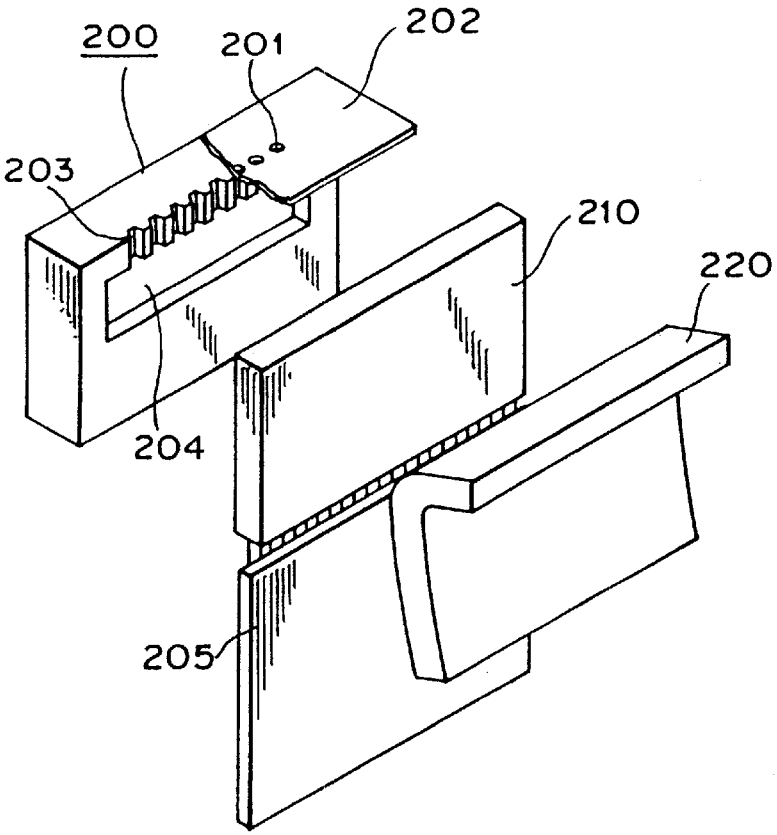
PRIOR ART FIG. 16
FIG. 16 is an exploded perspective view schematically showing another conventional ink jet print head.
Figure 17:
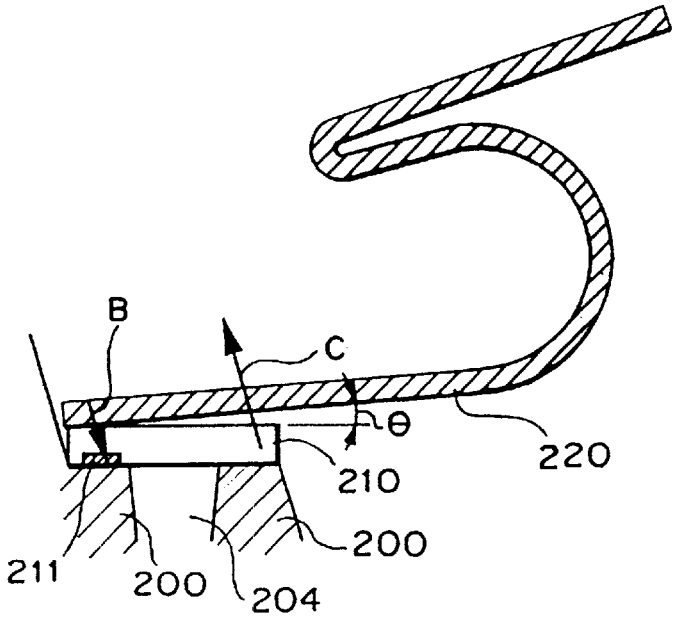
PRIOR ART FIG. 17
FIG. 17 is a schematic view showing a drawback of the conventional technology.

FIGS. 12 and 13 show the fifth embodiment of the invention.

In a construction in which the heater board 3 with the small base plate 3*a* used in the third and fourth embodiments and the grooved top plate 2 are joined together by the press member, the fifth embodiment is characterized in that the front end portion of the press member 1 is divided into two or more parts by a slit 1*a* as in the second embodiment. In the case of FIG. 13, the grooved top plate 2 has a plurality of divided liquid chambers 9.

This embodiment is intended to deal with a situation in which the small base plate 3*a,* when it is thin, may be deformed by the warped heater board 3. That is, the front end portion of the press member 1 is divided by the slit 1*a* into a plurality of front end blocks corresponding to the projections A, and the individual projections A provided one on each front end block independently press the heater board 3. Hence, the individual projections A can be pressed against the small base plate 3*a* following the warped surface contour of the small base plate 3*a,* improving the contact state of the grooved top plate 2 and the heater board 3.

(Other Examples)

In the ink jet printing system, this invention produces an excellent effect particularly in the print head and printing apparatus of a type which has a means to generate thermal energy for ejecting ink (e.g., electrothermal transducer and laser beam) and causes a status change in ink by the thermal energy. This is because this type of print head and printing apparatus can realize higher recording density and higher resolution.

As for the representative construction and working principle, this type of printing system preferably use a fundamental principle disclosed in U.S. Pat. Nos. 4,723,129 and 4,740,796. While this type of printing system is applicable to both the so-called on-demand type and the continuous type, it is particularly effectively applied to the on-demand type because the electrothermal transducer arranged in correspondence with a sheet or path containing liquid (ink) is applied at least one drive signal, which corresponds to print information and causes a rapid temperature rise in excess of a nucleate boiling, to generate thermal energy in the electrothermal transducer and cause a film boiling on the heat acting surface of the print head, thereby forming a bubble in ink that has a one-to-one correspondence to the drive signal. The growth and collapse of the bubble expels ink out of the orifice to form at least one drop of ink. The drive signal should preferably be in the form of pulse because the growth and collapse of the bubbles can be achieved instantaneously and appropriately, assuring the ejection of liquid (ink) with good response. Suitable pulse drive signals are those described in the U.S. Pat. Nos. 4,463,359 and 4,345,262. Better printing can be realized by using the conditions described in U.S. Pat. No. 4,313,124 related to the rate of increase of temperature on the heat acting surface.

In addition to the print head construction in which orifices, liquid paths (linear liquid paths or right-angle liquid paths) and electrothermal transducers are combined as disclosed in the specifications mentioned above, this invention includes a construction in which the heat acting portion is located in a bent area, as disclosed in U.S. Pat. Nos. 4,558,333 and 4,459,600. The present invention is also suited to the print heads that employ a construction in which a common slit is used as the orifice portion for a plurality of electrothermal transducers, as disclosed in Japanese Patent Application Laid-Open No. 59-123670, and a construction in which an opening for absorbing the pressure wave of thermal energy is used as the orifice portion, as disclosed in Japanese Patent Application Laid-Open No. 59-138461. That is, this invention ensures reliable and effective printing whatever form the print head may take.

Further, this invention can suitably be applied to a print head of full line type which has a length corresponding to the maximum recordable width of a recording medium. Such a print head may have a construction in which a plurality of print heads are combined to meet the required print length or a construction of a one-piece print head.

These serial type print heads, for which this invention is effective, include a print head fixed to the printer body, a replaceable chip type print head that is mounted to the printer body for electrical connection to and ink supply from the printer body, and a cartridge type print head that is integrally provided with an ink tank.

Further, an ink ejection performance recovery means and other auxiliary means for the print head may be provided in the printing apparatus of this invention. These are preferable as they contribute to further stabilizing the effects of this invention. Such auxiliary means may include a capping means, a cleaning means, a pressurization or suction means, an electrothermal transducer or heating element different from the electrothermal transducer or a preliminary heating means combining the electrothermal transducer and the heating element, and a preliminary ink ejection means for ejecting ink for other than printing, all for the print head.

As to the kind and the number of print heads mounted, it is possible to use only one print head for a single color ink or a plurality of print heads for different colors and densities. That is, this invention is particularly effective for the printing apparatus that uses at least one of the following print modes, whether the print head is a single one-piece print head or a combination of two or more print heads: a single color print mode with a mainstream color such as black, a composite color print mode using different colors and a full color print mode based on color mixing.

In addition, although the above embodiments have described ink as liquid, it is possible to use an ink that solidifies at room temperature or lower and softens or liquefies at room temperature. Because in the ink jet system the ink is generally temperature-controlled in the range of 30–70° C. to control the ink viscosity in a stable ejection range, it is also possible to use an ink that liquefies when a print signal is applied. Further, to positively prevent a temperature rise due to thermal energy by consuming the thermal energy as an energy required to cause a status change in ink from solid to liquid state, or to prevent the vaporization of ink, an ink that solidifies on standing and liquefies on heating may be used. In either case, this invention is also applicable where an ink used has a property of being liquefied only when it is given thermal energy. Example applications include one in which the ink is liquefied by the application of thermal energy in response to the print signal before being ejected and one in which the ink is made to start solidifying before it arrives at the recording medium. The ink used in these applications may be arranged as described in Japanese Patent Application Laid-Open No. 54-56847 or 60-71260, in which the ink in a liquid or solid state held in recesses or through holes in a porous sheet is opposed to the electrothermal transducers. The print system of this invention that is most suited for the above-described inks is the one that executes the film boiling method.

The ink jet printing apparatus of this invention may be implemented in the form of a copying machine combined with a reader and a facsimile having a transmission/reception function, as well as in the form of an image output terminal for information processing equipment such as computer.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. An ink jet print head comprising:

a grooved top plate module formed with a grooved top plate having a plurality of groove-like ink paths, a common liquid chamber for supplying ink to the plurality of ink paths and a plurality of orifices for ejecting ink;

a heater board having a plurality of heat generating elements for generating an ink ejection pressure arranged on a front surface of the heater board corresponding to the plurality of ink paths; and a press member for pressing and joining together the grooved top plate and the heater board;

wherein the press member presses against a back of the heater board at a vicinity of a joint gravity center of the heater board and the grooved top plate.

2. An ink jet print head according to claim 1, wherein said grooved top plate module includes a pair of grooved top plates disposed such that a groove-forming portion of each of said grooved top plates is oriented outwardly, and a pair of heater boards and a pair of press members are provided.

3. An ink jet print head according to claim 1, wherein the grooved top plate has a reference projection on a surface thereof facing the heater board at a position which is on a side of the common liquid chamber opposite the plurality of ink paths and which is at a center of the surface with respect to a direction of arrangement of the plurality of orifices.

4. An ink jet print head according to claim 1, wherein the press member presses against a plurality of points that are equidistant from the joint gravity center in a longitudinal direction of the ink paths.

5. An ink jet print head according to claim 1, wherein the press member is made of a metal.

6. An ink jet print head according to claim 1, wherein the press member is formed of a cantilever metal leaf spring, supported on the grooved top plate module.

7. An ink jet print head according to claim 3, wherein the joint gravity center is a center of gravity of a triangle, the triangle being formed by connecting end points of a line segment connecting longitudinal centers of the plurality of ink paths and an arrangement position of the reference projection.

8. An ink jet print head according to claim 4, wherein the press member has a plurality of projections that are pressed against a back of the heater board.

9. An ink jet print head according to claim 8, wherein the plurality of projections are arranged in a direction almost parallel to an arrangement direction of the plurality of orifices.

10. An ink jet print head according to claim 8, wherein the plurality of projections are spherical.

11. An ink jet print head comprising:

a grooved top plate module formed with a grooved top plate having a plurality of groove-like ink paths, a common liquid chamber for supplying ink to the plurality of ink paths and a plurality of orifices for ejecting ink;

a heater board having a plurality of heat generating elements for generating an ink ejection pressure arranged on a front surface of the heater board corresponding to the plurality of ink paths;

a press member for pressing and joining together the grooved top plate and the heater board; and a heat dissipating member arranged on a back of the heater board;

wherein the press member presses against a back of the heat dissipating member at a position on the heat dissipating member corresponding to a vicinity of a joint gravity center of the heater board and the grooved top plate.

12. An ink jet print head according to claim 11, wherein said grooved top plate module includes a pair of grooved top plates disposed such that a groove-forming portion of each of said grooved top plates is oriented outwardly, and a pair of heater boards and a pair of press members are provided.

13. An ink jet print head according to claim 11, wherein the grooved top plate has a reference projection on a surface thereof facing the heater board at a position which is on a side of the common liquid chamber opposite the plurality of ink paths and which is at a center of the surface with respect to a direction of arrangement of the plurality of orifices.

14. An ink jet print head according to claim 11, wherein the press member presses against a plurality of points that are equidistant from the joint gravity center in a longitudinal direction of the ink paths.

15. An ink jet print head according to claim 11, wherein the press member is formed of a cantilever metal leaf spring, supported on the grooved top plate module.

16. An ink jet print head according to claim 13, wherein the joint gravity center is a center of gravity of a triangle, the triangle being formed by connecting end points of a line segment connecting longitudinal centers of the plurality of ink paths and an arrangement position of the reference projection.

17. An ink jet print head according to claim 14, wherein the press member has a plurality of projections that are pressed against a back of the heat dissipating member.

18. An ink jet print head according to claim 17, wherein the plurality of projections are arranged in a direction almost parallel to an arrangement direction of the plurality of orifices.

* * * * *

UNITED STATES PATENT AND TRADEMARK OFFICE

CERTIFICATE OF CORRECTION

PATENT NO. : 6,394,574 B1
DATED : May 28, 2002
INVENTOR(S) : Yasuo Kotaki et al.

It is certified that error appears in the above-identified patent and that said Letters Patent is hereby corrected as shown below:

Title page,
Item [74], *Attorney, Agent, or Firm*, "Fitzpatrick Cella Harper & Scinto" should read -- Fitzpatrick, Cella, Harper & Scinto --.

Column 2,
Line 53, "ink paths 8." should read -- ink paths 203. --.

Column 7,
Line 30, "in." should read -- in --.

Column 8,
Line 18, "use" should read -- user --.

Column 9,
Line 60, "invention,"should read -- intention, --; and
Line 61, "apparent" should read -- appended --.

Signed and Sealed this

Second Day of September, 2003

JAMES E. ROGAN
*Director of the United States Patent and Trademark Office*